United States Patent [19]

Iida

[11] 4,216,700

[45] Aug. 12, 1980

[54] ACTUATOR DEVICE FOR ACTUATING EJECTOR OF SCRAPER

[75] Inventor: Akio Iida, Kawasaki, Japan

[73] Assignee: Kabushiki Kaisha Komatsu Seisakusho, Tokyo, Japan

[21] Appl. No.: 915,163

[22] Filed: Jun. 14, 1978

[30] Foreign Application Priority Data

Jun. 14, 1977 [JP] Japan ..... 52-76715[U]

[51] Int. Cl.[3] ..... F01B 7/00; F15B 11/16; F15B 13/06

[52] U.S. Cl. ..... 91/170 R; 91/447; 91/517; 92/62

[58] Field of Search ..... 92/62; 91/170 R, 412, 91/167 R, 517

[56] References Cited

U.S. PATENT DOCUMENTS

| | | | |
|---|---|---|---|
| 715,291 | 12/1902 | Potter | 91/167 |
| 1,994,974 | 3/1935 | Wiedmann | 91/412 |
| 2,485,805 | 10/1949 | Bent | 91/167 |
| 3,149,537 | 9/1964 | Fink | 92/62 |
| 3,832,937 | 9/1974 | Moore | 91/412 |

*Primary Examiner*—Paul E. Maslousky
*Attorney, Agent, or Firm*—Armstrong, Nikaido, Marmelstein & Kubovcik

[57] ABSTRACT

An actuator device for actuating ejector of a scraper comprising a first actuator having a long stroke, a second actuator having a short stroke, said first and second actuators being connected and fixedly secured in series so that the piston rod of said second actuator can be brought into contact with the piston of said first actuator, and valve means which normally permits the communication between the delivery side of a hydraulic pump and a pressure chamber of said first actuator and which also permits the communication between the delivery side of said pump and the pressure chamber of said second actuator when the pressure within the pressure chamber of said first actuator has increased beyond a predetermined value.

1 Claim, 3 Drawing Figures

ACTUATOR DEVICE FOR ACTUATING EJECTOR OF SCRAPER

BACKGROUND OF THE INVENTION

1. Field of the Invention

This invention relates to an actuator device, and more particularly to an actuator device for actuating an ejector of a scraper.

2. Description of the Prior Art

The ejector of a scraper is used for pushing the earth and sand when discharging them loaded in the bowl thereof on the ground. In general, a large power is required at the start of the operation, whilst a small power can meet the requirement near the end of the operation. Therefore, it is desired that the actuator for operating the ejector can develop a large power at the beginning of its stroke and reduce the power near the end of its stroke, but increase its moving speed.

The prior art actuator device for operating the ejector is disadvantages as disclosed, for example, in U.S. Pat. No. 3,035,361, in that it cannot develop a large power at the start of operation and has a low efficiency because of employing an ordinary actuator.

SUMMARY OF THE INVENTION

The present invention has been contemplated in view of the above-mentioned circumstances. A primary object of the present invention is to provide an actuator device for operating the ejector of a scraper which can develop a large power at the beginning of its stroke and which can reduce the power near the end of its stroke but increase the speed of movement thereof so as to achieve a high operational efficiency.

Another object of the present invention is to provide an actuator device for operating the ejector of a scraper comprising a double actuator which consists of two actuators each having a different stroke, the two actuators being fixed secured or connected in series, and valve means for controlling the supply of pressurized fluid into each of said two actuators.

A further object of the present invention is to provide a compact actuator device wherein said valve means is mounted on the actuator having a short stroke as an integral part thereof.

A still further object of the present invention is to provide an actuator device wherein said two actuators are separably constructed and can be used as an independent actuator.

In order to achieve the above objects of the present invention, there is provided an actuator device comprising: a first actuator both ends of which are closed by caps and in which a first piston is slidably accommodated and which has pressurized fluid supply and discharging ports formed at both ends thereof, said first piston having a piston rod projecting through the cap at the leading end thereof; a second actuator having an open end closed by the cap on the bottom side of said first actuator, said second actuator having a second piston slidably accommodated therein, said second piston having a piston rod extending through said cap on the bottom side and arranged opposite to the bottom face of the first actuator, said second actuator having pressurized fluid supply and discharging ports formed in both ends thereof; a slide valve including a vlave body formed as an integral part of the second actuator, said valve body having a spool slidably accommodated therein and biased by a spring in one direction; a load piston slidably mounted within a pressure chamber formed within said valve body on the opposite side of said spring, said load piston abutting against the rear end of said spool, said slide valve including a first inlet port which communicates with a port formed on the side of a bottom chamber of said first actuator, a second inlet port which communicates with a port formed on the side of a bottom chamber of said second actuator and which is permitted to communicate with said first inlet port when said spool is moved against the resilient force of the spring, a drain port which is normally communicated with said second inlet port and is cut off from communication the latter when the spool is moved against the biasing force of the spring and which always communicates with a port formed on the side of a rod chamber of said second actuator and a port which communicates said first inlet port with said pressure chamber, said slide valve including further an auxiliary port which leads to a chamber to be formed opposite to the rear end of the spool when the spool has been moved against the spring so as to permits communication between said chamber formed opposite to the rear end of the spool and said first inlet port; and an operating valve adapted to selectively supply the pressurized fluid deliverred by a pump into either a port formed on the side of a rod chamber of said first actuator or the first inlet port of said slide valve, wherein the stroke of said first actuator is longer than that of said second actuator.

BRIEF DESCRIPTION OF THE DRAWINGS

The above and other objects, features and advantages of the present invention will be apparent from the following description taken in conjunction with the accompanying drawings in which.

DETAILED DESCRIPTION OF THE PREFERRED EMBODIMENT

Figure 1:
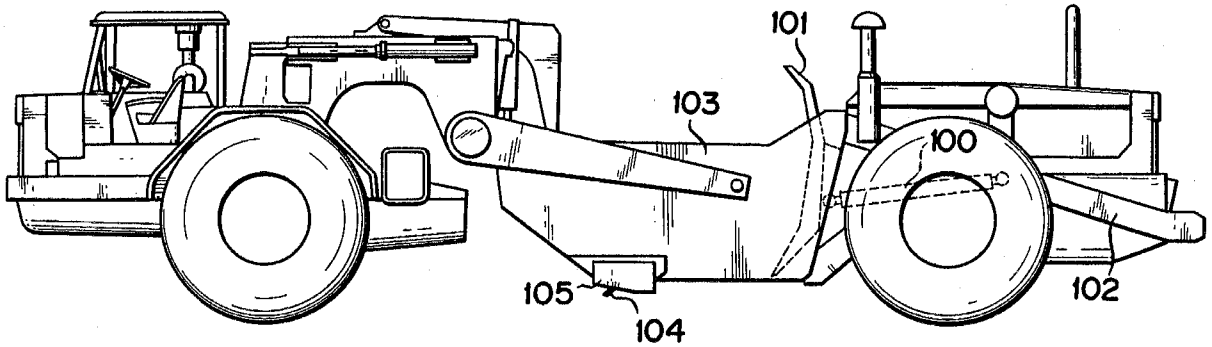
FIG. 1 is a side elevational view of a scraper provided with an actuator device of the present invention.

Reference is now made to FIG. 1 which is a side view of a scraper in which an actuator device 100 of the present invention is connected between an ejector 101 and a framework 102 of the scraper. Reference numeral 103 denotes a bowl of the scraper in which the earth and sand scraped by a blade 104 during the scraping operation is loaded through an end pit 105. When the earth and sand loaded in the bowl 103 is discharged, the ejector 101 is driven by the actuator 100 so as to discharge it through the lower pit 105 on the ground.

Figure 2:
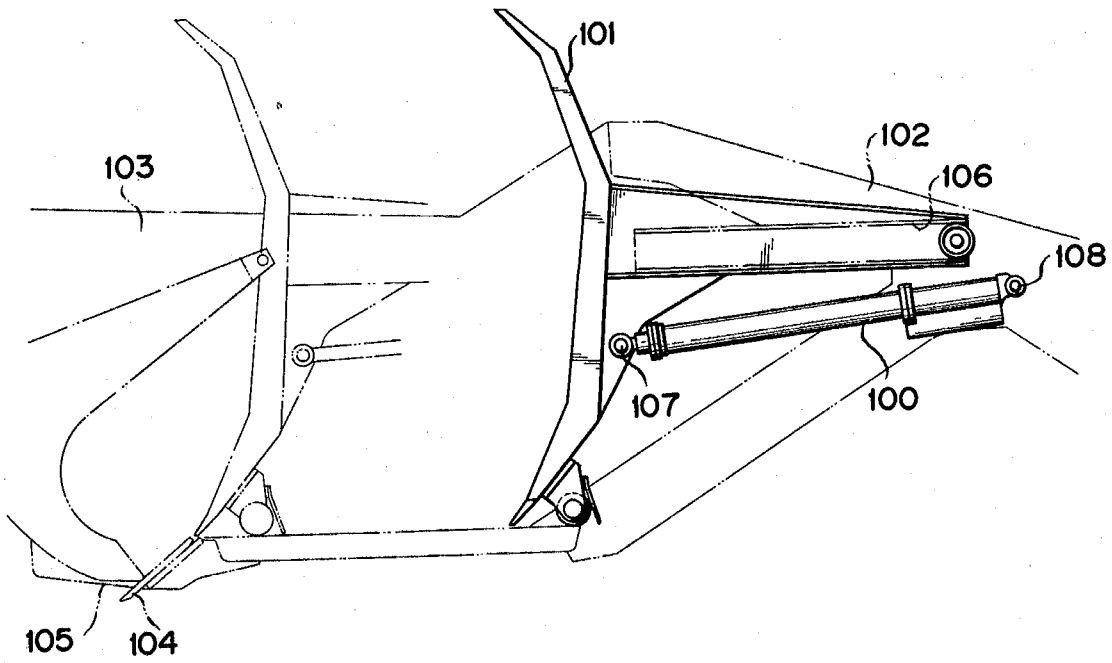
FIG. 2 is a fragmentary enlarged side elevational view of an ejector of the scraper shown in FIG. 1.

FIG. 2 is an enlarged view showing the ejector 101 and the actuator device 100 connected between the rear portion of the ejector 101 and the rear framework 102 of the scraper by means of pivot pins 107 and 108 so that the ejector 101 can be moved along a guide 106 within the bowl 103.

The present invention will now be described in detail below with reference to FIG. 3 which is an enlarged sectional view of the actuator device 100.

Figure 3:
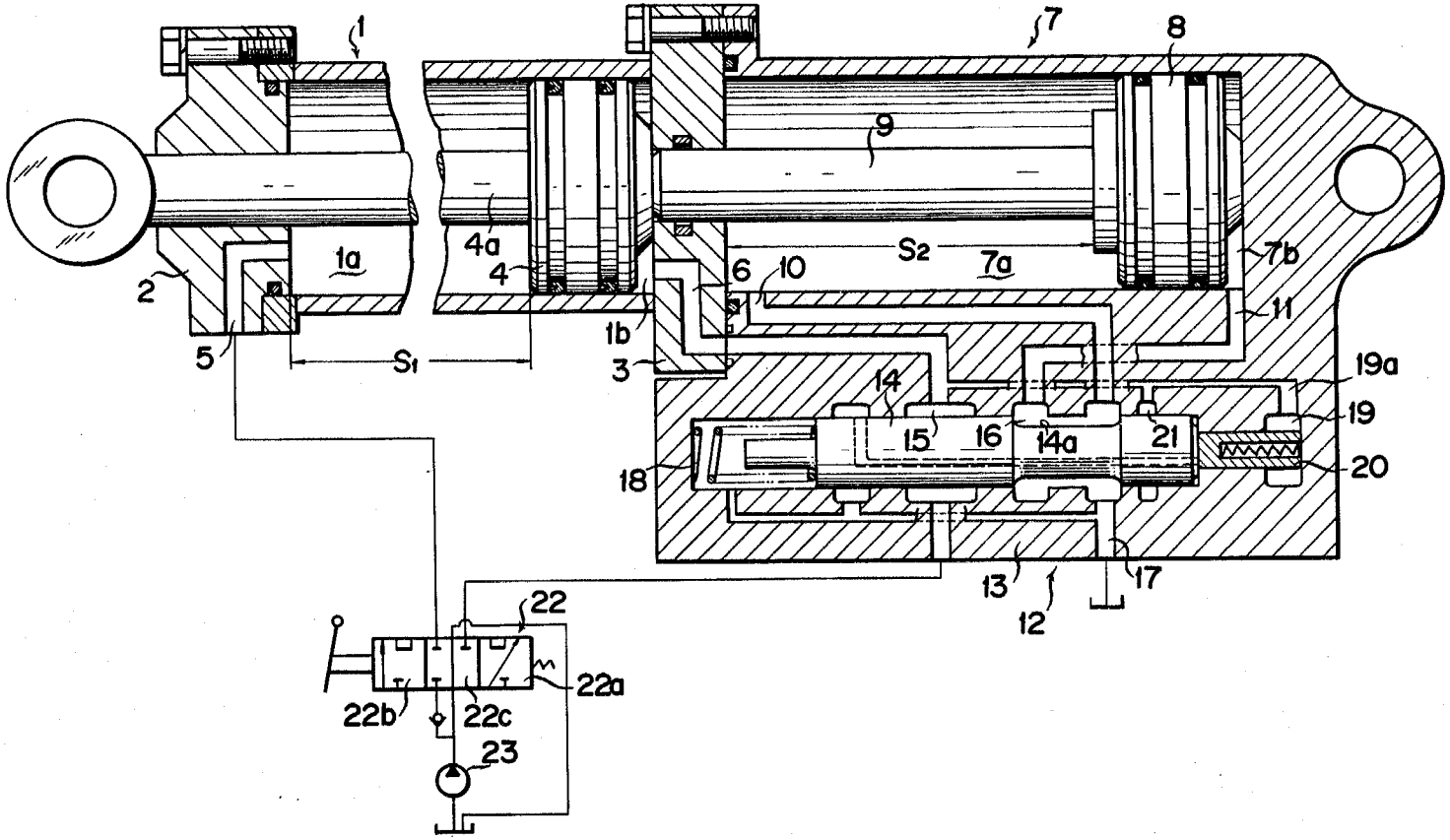
FIG. 3 is a fragmentary enlarged sectional view of the actuator device of the present invention.

In FIG. 3, reference numeral 1 denotes a first actuator, both ends of which are closed by a first cap 2 and a second cap 3 and which has a piston 4 having a rod 4a projecting through the cap 2. The caps 2 and 3 have ports 5 and 6 formed therein so as to communicate with a rod chamber 1a and a bottom chamber 1b of the first actuator 1, respectively.

Reference numeral 7 denotes a second actuator having open one end, the open end being fixedly secured to the cap 3 on the bottom side of the first actuator 1 so as to be closed thereby. The second actuator 7 includes a piston 8 which is fitted therein and has a rod 9 extending through the cap 3 and facing the end face of the piston 4 of the first actuator 1. The second actuator 7 includes a rod chamber 7*a* and a bottom chamber 7*b* having ports 10 and 11 formed therein, respectively.

In the arrangement of the above-mentioned actuators 1 and 7, the stroke $S_1$ of the first actuator 1 is longer than the stroke $S_2$ of the second actuator 7.

Reference numeral 12 denotes a slide valve which comprises a valve body 13 formed as an integral part of the second actuator 7 and a spool 14 slidably inserted within the valve body 13. The valve body 13 has formed therein a first inlet port 15 which communicate with the port 6 of the bottom chamber 1*b* of the first actuator 1, a second inlet port 16 which communicates with the bottom chamber 7*b* of the second actuator 7 and a drain port 17 which communicates with the port 10 of the rod chamber 7*a* of the second actuator 7.

The spool 14 is biased by a spring 18, and under such condition its small diameter portion 14*a* allows the communication between the second inlet port 16 and the drain port 17. On the side of the spool 14 oposite to the spring 18, the end face of a load piston 20 having a smaller diameter than that of the spool 14 and located within a pressure chamber 19 abuts against the right hand end of the spool 14. The pressure chamber 19 communicates through a port 19*a* with the first inlet port 15. When the above-mentioned spool 14 is moved to the left in the drawing against the resilient force of the spring 18 by the action of the load piston 20, the reduced diameter portion 14*a* permits the communication between the first inlet port 15 and the second inlet port 16, and at the same time the communication between the second inlet port 16 and the drain port 17 is cut off.

The valve body 13 has an auxiliary port 21 formed therein which communicates with a chamber to be formed on the other end of the spool 14 when the spool has been moved to the left against the biasing force of the spring 18, the auxiliary port 21 communicating with the first inlet port 15.

Reference numeral 22 indicates an operating valve having a forward position 22*a*, a reversing or backward position 22*b* and a neutral position 22*c*. The change-over operation of the valve 22 enables the fluid deliverred by a pump 23 to be selectively supplied into either the first inlet port 15 of the slide valve 12 or the port 5 of the rod side chamber of the first actuator 1.

In the above-mentioned arrangement, when the operating valve 22 assumes its forward position 22*a* so as to supply the fluid from the pump 23 into the first inlet port 15, the fluid is introduced into the bottom chamber 1*b* of the first actuator 1, thereby moving the piston rod 4*a* of the first actuator 1 to the left. At that time, if a load of more than a predetermined value is exerted on the rod 4*a*, the pressure within the flow passage and the pressure chamber 19 will increase beyond the predetermined value so that the spool 14 of the slide valve 12 can be moved to the left against the resiliency of the spring 18. As a result, the first inlet port 15 is permitted to communicate with the second inlet port 16 so that the fluid under pressure deliverred by the pump 23 is introduced into the bottom chamber 7*b* of the second actuator 7 thereby to extend the rod 9 of the piston 8 of the second actuator 7.

Therefore, the operating force F of the piston rod 4*a* of the first actuator 1 is given by the following formula.

$$F=\{a_1+(a_2-b)\}P$$

Wherein $a_1$ is cross sectional area of piston 8 of the second actuator 7; $a_2$ is cross-sectional area of the piston 4 of the first actuator; b is cross-sectional area of the piston rod 9 of the second actuator 7; and P is a fluid pressure.

The operating force F at the start of operation is large, and the large operating force F is maintained during the stroke $S_2$ of the piston 8 of the second actuator 7.

After the piston 8 of the second actuator 7 has reached the end of its stroke, the movement is made only by the piston 4 of the first actuator 1 and the operating force F is reduced so that the whole fluid is supplied into the bottom chamber 1*b* of the first actuator 1 thereby increasing the speed of movement of the piston 4.

Further, when both the first actuator 1 and the second actuator 7 are rendered operative, the fluid pressure will be reduced because the two actuators act to push the load. Consequently, the pushing force of the load piston 20 is reduced so as to cause the tendency of moving-back of the spool 14 by the action of the spring 18. However, since the end face of the spool 14 is opposite to the auxiliary port 21 at the stroke end thereof, the spool 14 is urged by the fluid pressure within the auxiliary port 21 against the biasing force of the spring 18. Therefore, even if there is a pressure drop as mentioned above, the spool 14 is not moved back immediately thereby preventing generation of chattering of the spool 14.

Though in the foregoing description there is disclosed an example comprising two actuators, it is of course possible to form the device with actuators of three or more. Further, the device of the present invention can be easily manufactured because each actuator is made separately. Moreover, general application of the device is available since each of the actuators can be used independently as an actuator for general use.

While this invention is susceptible of embodiment in many different forms, there is shown in the drawings and has been described herein in detail a specific embodiment of the invention, with the understanding that the present disclosure is to be considered as an exemplification of the principle of the invention and is not intended to limit the invention to the embodiment illustrated.

What is claimed is:

1. An actuator device comprising:

(a) a first actuator having two ends which are closed by a first cap and a second cap, and in which a first piston is slidably accommodated and which has pressurized fluid supply and discharging ports formed at both ends thereof, said first piston having a top surface and a bottom face and a piston rod projecting through said first cap extending from said top surface;

(b) a second actuator having an open end closed by said second cap of said first actuator, said second actuator having a second piston slidably accommodated therein, said second piston having a piston rod extending through said second cap, said piston rod arranged opposite to the bottom face of the first piston and adapted to abut said bottom face, said second actuator having pressurized fluid supply and discharging ports formed in both ends thereof;

(c) a slide valve including a valve body formed as an integral part of the second actuator, said valve body having a spool slidably accommodated therein and biased by a spring in one direction;

(d) a load piston slidably mounted within a pressure chamber formed within said valve body on the opposite side of said spring, said load piston abutting against the rear end of said spool, said slide valve including a first inlet port which communicates with a port formed on the side of a bottom chamber of said first actuator, a second inlet port which communicates with a port formed on the side of a bottom chamber of said second actuator and which is permitted to communicate with said first inlet port when said spool is moved against the resilient force of the spring, a drain port which is normally communicated with said second inlet port and is cut off from communication with the latter when the spool is moved against the biasing force of the spring and which always communicates with a port formed on the side of a rod chamber of said second actuator and a port which communicates said first inlet port with said pressure chamber, said slide vlave including further an auxiliary port which leads to a chamber to be formed opposite to the rear end of the spool when the spool has been moved against the spring so as to permit communication between said chamber formed opposite to the rear end of the spool and said first inlet port; and (e) an operating valve adapted to selectively supply the pressurized fluid delivered by a pump into either a port formed on the side of a rod chamber of said first actuator or the first inlet port of said slide valve, wherein the stroke of said first actuator is longer than that of said second actuator.

* * * * *